United States Patent [19]

Mok et al.

[11] Patent Number: 4,633,258

[45] Date of Patent: Dec. 30, 1986

[54] PHASE SLOPE EQUALIZER

[75] Inventors: Chuck K. Mok, Beaconsfield; Alain Martin, Vaudreuil, both of Canada

[73] Assignee: SPAR Aerospace Limited, Ontario, Canada

[21] Appl. No.: 618,446

[22] Filed: Jun. 7, 1984

[51] Int. Cl.[4] ..... H01Q 3/22; H01Q 13/00; H01P 7/06

[52] U.S. Cl. ..... 342/373; 343/778; 333/231

[58] Field of Search ..... 343/373, 778, 767, 777; 333/232, 227, 228, 233

[56] References Cited

U.S. PATENT DOCUMENTS

| | | | |
|---|---|---|---|
| T102,002 | 7/1982 | Jobera | 343/854 |
| 2,461,005 | 2/1949 | Southworth | 343/777 |
| 2,642,529 | 6/1953 | Frankel | 343/767 |
| 2,905,940 | 9/1959 | Spencer et al. | 343/778 |
| 3,108,237 | 10/1963 | Reuvers et al. | 343/778 |
| 3,275,952 | 9/1966 | Korman | 343/778 |
| 3,553,692 | 1/1971 | Drabowitch | 343/778 |
| 3,611,400 | 10/1971 | Nagal | 343/844 |
| 3,911,442 | 10/1975 | Hatch | 343/754 |
| 3,955,161 | 5/1976 | Macturk | 333/73 W |
| 4,041,421 | 8/1977 | Owlett | 333/232 |
| 4,117,491 | 9/1978 | Hanna et al. | 343/742 |
| 4,321,568 | 3/1982 | Joyal et al. | 333/232 |

*Primary Examiner*—Theodore M. Blum
*Assistant Examiner*—David Charles Cain
*Attorney, Agent, or Firm*—Nies, Webner, Kurz & Bergert

[57] ABSTRACT

A microwave antenna feed network dispenses with the conventional phase shifters. Instead, the required phase relationships between the different individual antenna components is achieved by means of a new device, known as a phase slope equalizer, placed in each feed line. This device is formed of a section of waveguide containing one or more resonant circuit elements. Each element comprises, for example, a pair of spaced inductive posts and capacitive tuning screw, or an inductive iris and a capacitive tuning screw, or a resonant slot. The phase slope equalizer exhibits a substantially constant slope phase shift/frequency response curve extending from a positive phase shift through zero phase shift at midband to a negative phase shift. The device is simpler and smaller than the conventional phase shifter and fewer are required thereby reducing costs.

31 Claims, 16 Drawing Figures

PHASE SLOPE EQUALIZER

BACKGROUND OF THE INVENTION

This invention relates to antenna feed networks and, in particular, feed networks for satellite antennas.

Currently such feed networks include phase shifters and trombones to provide the required phase relationships. The phase shifters are of two types, namely inductive and capacitive, to ensure not only correct phase at midband but also to achieve equal phase slope among the many runs leading to the antenna horns. Many phase shifters are used in a typical communication satellite; for example, the G-STAR antenna has over a hundred phase shifters.

The cost of the phase shifter represents a major component in the overall cost of the feed network and the space occupied by the phase shifters significantly increases the size of the feed network.

SUMMARY OF THE INVENTION

It is a primary object of the invention to replace the phase shifter in the antenna feed network with a device which is smaller and simpler than the phase shifter and which is required in fewer numbers than the phase shifter in any one feed network, thereby reducing the cost and size of the feed network.

The novel device, known hereinafter as a phase slope equalizer, is placed in each run of the antenna. The phase slope equalizer comprises, in essence, a resonant circuit placed in a waveguide. In one specific embodiment the resonant circuit is a parallel resonant circuit comprising a pair of inductive posts with a capacitive tuning screw located between the posts.

Instead of the posts, in an alternative embodiment an inductive iris is used. Again, the capacitive element is a tuning screw.

A third embodiment is in the form of a resonant slot which replaces both the inductive posts and the capacitive tuning screw.

For larger phase slopes, it is preferred that there be two or more identical elemental circuits, connected typically one quarter-wave apart. This arrangement, which is applicable with the inductive post version, inductive iris version or resonant slot version, improves the bandwidth of the unit.

BRIEF DESCRIPTION OF THE DRAWINGS

FIG. 2(*b*) is a schematic diagram showing the same phase slope equalizer from the top.

FIG. 9(*b*) is a top view of the 4-element phase slope equalizer shown in FIG. 9(*a*).

FIG. 10(*b*) is a top view of the alternative design for a 4-element phase slope equalizer, shown in FIG. 10(*a*).

DESCRIPTION OF THE PREFERRED EMBODIMENTS

Figure 1:
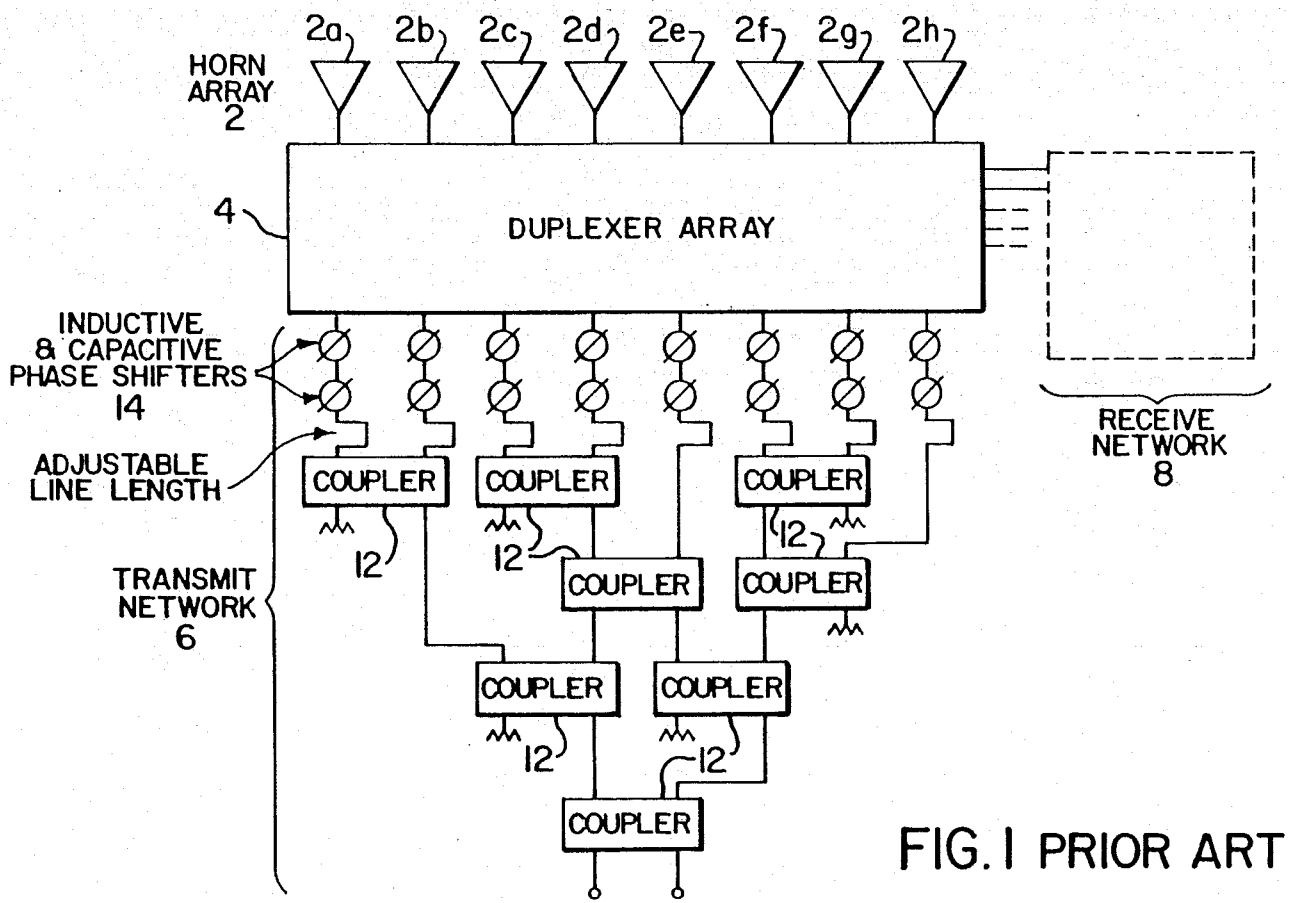
FIG. 1 PRIOR ART
FIG. 1 is a schematic view of a conventional prior art antenna feed network.

The significance of the invention will be better understood after a brief review of a conventional prior art antenna feed network as shown in FIG. 1.

With reference to FIG. 1 the antenna feed network comprises a horn array 2, a duplexer (also known as diplexer) array 4, a transmit network 6 and a receive network 8.

The horn array 2 comprises a plurality (eight illustrated in this example) of individual horns 2*a*–2*h* all of which are positioned to direct individual radio frequency beams onto a reflector (not shown) which redirects a combined beam to the desired coverage area on earth.

The duplexer array 4 simply provides a means for allowing the transmit 6 and receive 8 networks to share the same array of horns, and for the purposes of understanding the present invention, need not be described further herein.

The transmit network 6 is similar in detailed construction and operation to the receive network 8 and, accordingly, only the transmit network will be described in greater detail. Within the transmit network 6 are a plurality of couplers 12 and phase shifters 14. The couplers 12 distribute power among the horns 2*a*–2*h* in a prescribed manner. By varying the line lengths appropriately and by selecting appropriate phase shifters 14, ensure the desired phase relationship among the horns may be achieved. Although two phase shifters 14 are shown in each feed line 16, the lines may have more than two phase shifters.

The phase shifters 14 used are of two types, capacitive and inductive. These give respectively negative and positive phase offsets. The phase offset however varies with frequency. Thus, if a 90° phase difference is required between two lines, a single 90° phase shifter placed in one of the lines will give the correct phase relationship at one frequency only, say at midband; there will be an error at the bandedges. To avoid this error, it is necessary to use a +45° phase shifter in one line and a −45° phase shifter in the other. The two phase shifters, although having differing signs, both have the same phase slope. That is, a capacitive phase shifter having numerically the same phase offset at midband as that of an inductive phase shifter, will also have the same algebraic slope. In a typical feed therefore, combinations of different capacitive and inductive phase shifters are used throughout.

The present invention involves a new approach using a new component, called a phase slope equalizer. As will be described in more detail below, this component has zero phase offset at midband but has a substantially constant phase slope across the bandwidth.

Phase correction therefore becomes relatively simple. The path lengths of the various feed lines are arranged to give the required phase offsets at midband only and then phase slope equalizers (one per line) are introduced to equalize the slopes among the lines 16. The slopes of all these equalizers have the same sign. This new approach dispenses with the inductive and capacitive phase shifters 14.

Figure 1A:
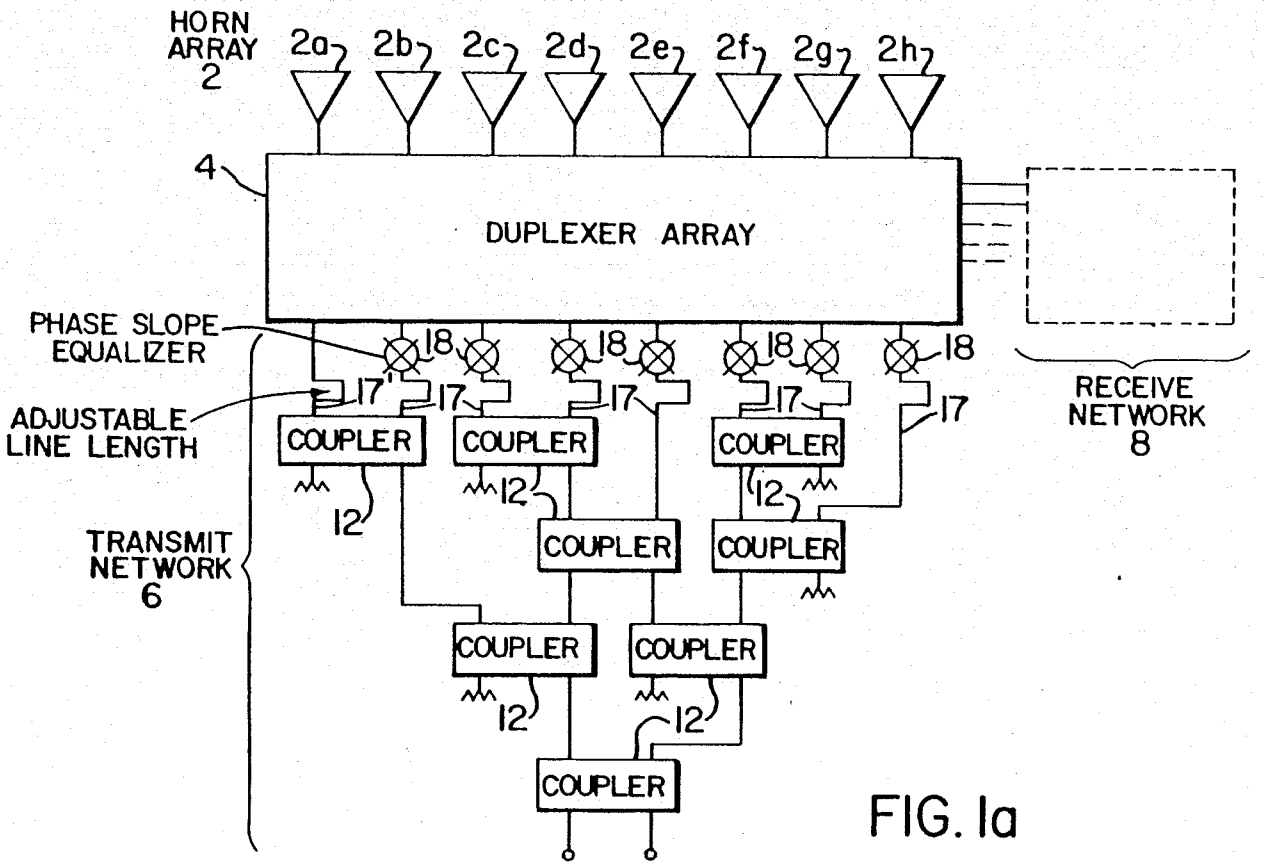
FIG. 1*a* is a schematic view similar to FIG. 1 but showing the use of phase slope equalizers according to the present invention instead of prior art phase shifters, as shown in FIG. 1.

The technique of the present invention is described in greater detail with reference to FIG. 1*a*. As mentioned in the preceding paragraph the relative path lengths of the individual feed lines 17 are selected to define the predetermined phase offsets relative to one another in the region of the midband frequency. Each feed line 17 has a sloping phase shift/frequency response characteristic the slope of which is determined by the length of the feed line. To correct for the different slopes, a phase slope equalizer 18 is inserted into each feed line 17 except for that feed line the phase shift/frequency response characteristic of which has the greatest slope. By way of example, as shown in FIG. 1*a*, the leftmost feed line 17' is assumed to have the greatest length and hence the greatest offset and slope. Accordingly, it obviously does not need and therefore does not include a phase slope equalizer.

Figure 2A:
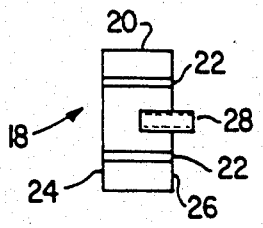
FIG. 2(*a*) is a schematic diagram showing from the side a single element phase slope equalizer.
Figure 2B:
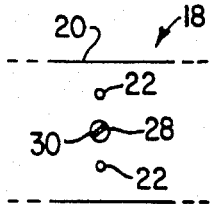

FIGS. 2(*a*) and 2(*b*) illustrate an example of the new phase slope equalizer 18. It comprises a rectangular section waveguide 20 across the smaller dimension of which extend two metal posts 22 which are both soldered to opposite faces 24 and 26 of the waveguide 20. A metal tuning screw 28 is received in a threaded hole (not shown) in face 26 of waveguide 20 and extends inwardly of the waveguide at a location intermediate the posts 22 and parallel thereto. A portion of screw 28 extends outwardly of the wave guide and is provided with a slot 30 which may be engaged by a screwdriver for moving the screw further inwardly or outwardly to increase or decrease the capacitance as necessary to tune the device to the midband frequency.

Figure 3:
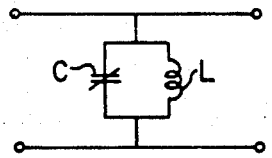
FIG. 3 is an equivalent electrical circuit diagram of the phase slope equalizer shown in FIGS. 2(*a*) and 2(*b*).

FIG. 3 is the equivalent diagram of the phase slope equalizer 18 of FIGS. 2(*a*) and 2(*b*). Essentially the device operates as a shunt resonator comprising an inductance L representing the inductance of the posts 22 and a variable capacitor C representing the variable capacitance of the tuning screw 28.

Figure 4:
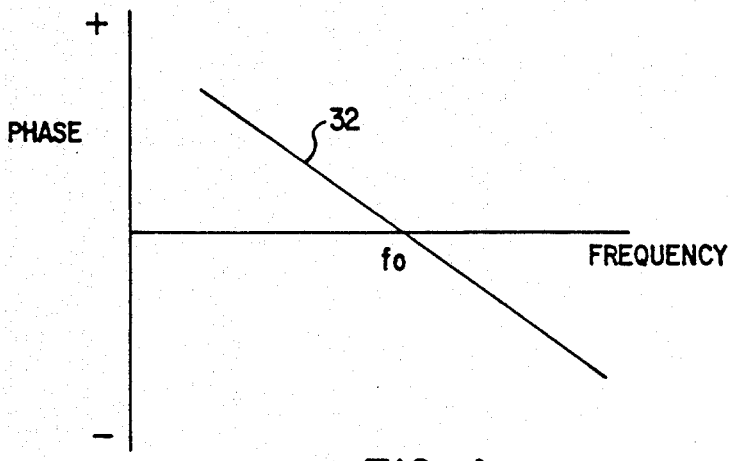
FIG. 4 is a graph of phase shift against frequency representing the response of the phase slope equalizer of FIGS. 2(*a*) and 2(*b*).

Below resonance the circuit is shunt inductive giving a positive phase shift, while above resonance the circuit is shunt capacitive, giving a negative phase shift as illustrated in FIG. 4. At resonance, or midband, it is shunt open-circuit giving zero phase shift. It can be seen that the phase shift/frequency response curve 32 is essentially a straight line passing through the midband frequency $f_0$ at zero phase offset, the slope of the line being negative, substantially constant and a function of L and C. In other words, for a particular tuning, the more the midband frequency $f_0$ exceeds a given frequency the more positive is the phase shift $\phi$ and the more a given frequency exceeds $f_0$ the more negative is the phase shift $\phi$.

Although according to the simple theory to be described, there is zero phase offset at midband, the practical realization has a small (say 20°) positive phase offset at midband. This is because the representations of the inductive posts and the capacitive screw as single shunt inductance and single shunt capacitance respectively, are only approximate ones. A more accurate representation for each is a $\pi$ circuit and this will result in a finite positive phase offset at midband. In practice therefore, to compensate for the finite phase offset at midband, a short length of line (say 0.1 inch) is introduced to cancel this positive phase offset.

Figure 5:
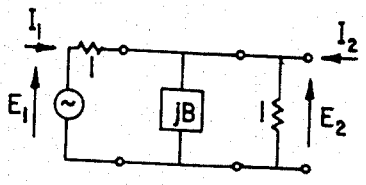
FIG. 5 is a circuit diagram based on FIG. 3 for use in explaining the theory behind the invention.

A more detailed treatment of the theory behind the operation of the circuit of FIG. 3 will now be given. When the circuit of FIG. 3 is connected in a line it may be represented by FIG. 5 in which jB represents the impedance of the shunt resonator, E1 is the input voltage and E2 is the output voltage.

The matrix product for the circuit

The matrix product for the circuit =

$$\begin{pmatrix} 1 & 1 \\ 0 & 1 \end{pmatrix} \begin{pmatrix} 1 & 0 \\ jB & 1 \end{pmatrix} \begin{pmatrix} 1 & 0 \\ 1 & 1 \end{pmatrix} = \begin{pmatrix} 2+jB & 1 \\ 1+jB & 1 \end{pmatrix} = \begin{pmatrix} A & B \\ C & D \end{pmatrix} \text{ say}$$

$$\text{i.e.} \begin{pmatrix} E_1 \\ I_1 \end{pmatrix} = \begin{pmatrix} A & B \\ C & D \end{pmatrix} \begin{pmatrix} E_2 \\ I_2 \end{pmatrix} \quad I_2 = 0 \quad E_1 = AE_2$$

Phase shift, $$\phi = arg \frac{E_2}{E_1} = arg\left(\frac{1}{A}\right) = \tan^{-1}\left(\frac{-B}{2}\right)$$

For a shunt resonator, $$B = B_0\left(\frac{f}{f_0} - \frac{f_0}{f}\right)$$

where $B_0 = 2\pi f_0 \cdot C$, $f_0$ = centre frequency and

C = resonator capacitance

For example, at K-band, $f_1 = 11.7$ GHz $f_2 = 12.2$ GHz $f_0 = 11.95$ GHz

For $B_0 = 5$ $$B_1 = B_0|_{f_1} = B_0\left(\frac{f_1}{f_0} - \frac{f_0}{f_1}\right) = 5\,(-0.042) = .21$$

Therefore $$\phi_1 = \phi|_{f_1} = 6°$$

Similarly $$\phi_2 = \phi|_{f_2} = -5.9°$$

Typically $\phi$ is not larger than 5°. This corresponds to $B_1 = -2 \tan \phi = -0.175$ It can be shown that the return loss, RL is related to B by $$RL = -10 \log_{10}\left(\frac{4 + B^2}{B^2}\right)$$

Therefore for $B_1 = -0.175$
RL=21.2 dB

Figure 6:
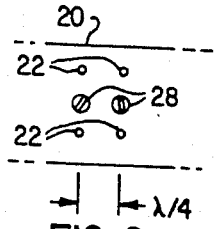
FIG. 6 is a view similar to FIG. 2(*b*) but showing a 2 element phase slope equalizer.

That is, the return loss at the bandedge is 21.2 dB. If required, the return loss can be improved by using two smaller elements, each giving half the slope, separated by quarter wavelength as shown in FIG. 6. Typically, the waveguide, posts and screws are made of aluminum, the waveguide is 0.75" wide, the posts 0.062" in diameter and the screws 0.20" in diameter. The quarter wavelength distance between the elements corresponds to 0.328". Small phase slope can of course be compensated by a single element. Conversely in situations where larger than ±5°/500 MHz slope is required, then 3- or 4-element designs could be used.

Figure 9A:
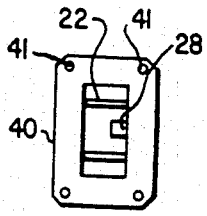
FIG. 9(*a*) is a side view of a 4-element phase slope equalizer according to the invention.
Figure 9B:
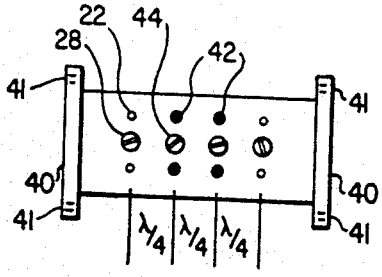

For designs with more than two elements it is preferred, for performance reasons, to have all the inner elements, each having twice the susceptance of that of the first (or last) element. For example, if the susceptance $B_0$ of the first (or last) element is equal to 5, then all of the other elements should each have a susceptance of 10. The spacing between consecutive elements is quarter-wave at the midband. An example of a 4-element device shown in FIG. 9 in which waveguide 20 has two end flanges 40 containings holes 41 adapted to receive bolts (not shown) for connection to flanged portions of the waveguide line (not shown). The first element and the last element each comprises a pair of spaced posts 22 and a tuning screw 28 of the type shown schematically in FIGS. 2(*a*) and 2(*b*). The second and third elements, spaced from each other and from the first and last elements by a quarter wavelength, each comprises a pair of spaced posts 42 of greater diameter than posts 22 to provide an inductance twice that of posts 22 and a tuning screw 44 of greater length than screws 28 to provide a capacitance twice that of screws 28.

Figure 10A:
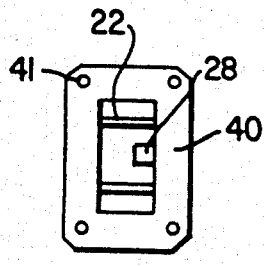
FIG. 10(*a*) is a side view of an alternative design for a 4-element phase slope equalizer.
Figure 10B:
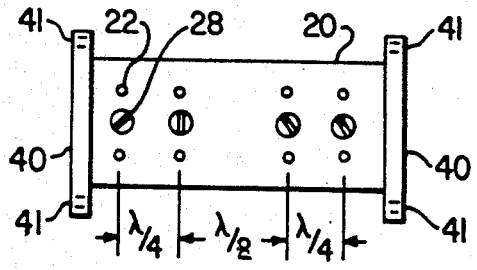

Alternatively, if it is desired, for reasons of economy in production, to have all the elements identical, then the arrangement of FIG. 10 showing a 4-element design can be used. This has the two inner elements spaced half-wave apart. In essence, the first two elements form a pair, whose centre is spaced three quarter-wave from the centre of the pair formed by the third and last elements. It is recommended, for designs with even more than 4 elements, that the former (i.e. every spacing is quarter-wave) be used.

Figure 7A:
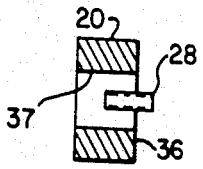
FIGS. 7(*a*) and 7(*b*) are views similar to FIGS. 2(*a*) and 2(*b*) but illustrating the inductive iris type phase slope equalizer.
Figure 7B:
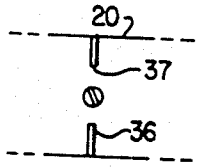

An alternative embodiment of phase slope equalizer is shown in FIGS. 7(*a*) and 7(*b*). Here, instead of inductive posts, an inductive iris 36 is used. The iris is formed as a thin metal plate defining an aperture 37 into which extends the tuning screw 28.

Figure 8A:
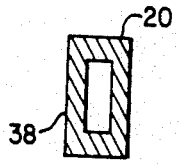
FIGS. 8(*a*) and 8(*b*) are views similar to FIGS. 2(*a*) and 2(*b*) but illustrating the resonant slot type phase slope equalizer.
Figure 8B:
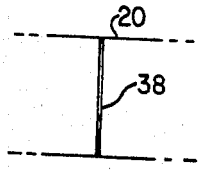

A further alternative is shown in FIGS. 8(*a*) and 8(*b*). In this example the posts and tuning screw are replaced with a resonant slot 38 which resonates at the midband frequency.

As in the case of the inductive post type, the embodiments using an inductive iris or resonant slot may be provided with two or more elemental resonant circuits. The same considerations regarding spacing and susceptance as discussed in relation to FIGS. 9 and 10 apply to the multi-element iris or resonant slot type. Thus far, for the multi-element phase slope equalizer, two basic embodiments have been described. The first is where the inner elements are identical but of double the susceptance of the first (and last) element. The second is where all the elements are identical but their separations are unequal. In general, other distributions of element values (i.e. unequal elements) can be synthesized to give a somewhat different performance, (e.g. different bandwidth). The separation between elements is essentially quarter-wave or multiples of quarter-wave.

What we claim as our invention is:

1. A feed network for a microwave antenna of the type having a plurality of individual antenna components connected respectively to individual feed lines and sending or receiving signals in predetermined phase offsets relative to one another, the relative lengths of the feed lines being selected to define the predetermined phase offsets in the region of the midband frequency, each feed line having a phase shift/frequency response characteristic, the slope of which is determined by the length of the feed line, the network including, in at least each feed line which has a lesser said slope than the feed line, the phase shift/frequency response characteristic of which, has the greatest slope, a phase slope equalizer having a substantially constant slope phase shift/frequency response curve extending from a positive phase shift through zero phase shift in the region of the midband frequency to a negative phase shift, the slope of the phase shift/frequency response curve of each phase slope equalizer being equal to the difference in slope between the feed line containing the phase slope equalizer and the line with the greatest slope.

2. A feed network according to claim 1 in which each phase slope equalizer comprises a waveguide section containing a resonant circuit.

3. A feed network according to claim 2 in which the resonant circuit is a shunt circuit.

4. A feed network according to claim 3 in which the resonant circuit comprises two spaced inductive posts extending across the waveguide section and a capacitive tuning screw received in a threaded hole in the waveguide section and extending inwardly of the waveguide section at a location intermediate the posts and parallel thereto.

5. A feed network according to claim 3 in which the resonant circuit comprises an inductive iris located in the waveguide section and defining an aperture and a capacitive tuning screw received in a threaded hole in the waveguide section and extending inwardly of the waveguide section at the location of the aperture.

6. A feed network according to claim 3 in which the resonant circuit comprises a resonant slot located in the waveguide section.

7. A feed network according to claim 3 in which the resonant circuit is formed as a plurality of identical elemental resonant circuits.

8. A feed network according to claim 4 in which, in addition to the set of two inductive posts and capacitive tuning screw, the waveguide section also houses at least one other set of two inductive posts and capacitive tuning screw, the various sets being spaced at predetermined intervals along the waveguide section.

9. A feed network according to claim 8 in which all the sets have the same susceptance, the spacing between each outer set and its nearest set is a quarter wavelength and the spacing between any two inner sets is a quarter-wavelength or multiples of quarter-wavelength.

10. A feed network according to claim 8 in which the susceptance of each outer set is half that of each inner set and the spacing between consecutive sets is a quarter wavelength.

11. A feed network according to claim 5 in which, in addition to the set of the inductive iris and capacitive tuning screw, the waveguide section also houses at least one other set of inductive iris and capacitive tuning screw, the various sets being spaced at predetermined intervals along the waveguide section.

12. A feed network according to claim 11 in which all the sets have the same susceptance, the spacing between each outer set and its nearest set is a quarter wavelength and the spacing between any two inner sets is a quarter-wavelength or multiples of quarter wavelength.

13. A feed network according to claim 11 in which the susceptance of each outer set is half that of each inner set and the spacing between consecutive sets is a quarter wavelength.

14. A feed network according to claim 6 in which, in addition to the resonant slot, the waveguide section also houses at least one other resonant slot, the various resonant slots being spaced at predetermined intervals along the waveguide section.

15. A feed network according to claim 14 in which all the slots have the same susceptance, the spacing between each outer slot and its nearest slot is a quarter wavelength and the spacing between any two inner slots is a quarter-wavelength or multiples of quarter wavelength.

16. A feed network according to claim 14 in which the susceptance of each outer slot is half that of each inner slot and the spacing between consecutive slots is a quarter wavelength.

17. A phase slope equalizer comprising a waveguide section containing a resonant circuit which has a substantially constant slope phase shift/frequency response curve extending from a positive phase shift through zero phase shift in the region of the midband frequency to a negative phase shift.

18. A phase slope equalizer according to claim 17 in which the resonant circuit is a shunt circuit.

19. A phase slope equalizer according to claim 18 in which the resonant circuit comprises two spaced inductive posts extending across the waveguide section and a capacitive tuning screw received in a threaded hole in the waveguide section and extending inwardly of the waveguide section at a location intermediate the posts and parallel thereto.

20. A phase slope equalizer according to claim 18 in which the resonant circuit comprises an inductive iris located in the waveguide section and defining an aperture and a capacitive tuning screw received in a threaded hole in the waveguide section and extending inwardly of the waveguide section at the location of the aperture.

21. A phase slope equalizer according to claim 18 in which the resonant circuit comprises a resonant slot located in the waveguide section.

22. A phase slope equalizer according to claim 18 in which the resonant circuit is formed as a plurality of identical elemental resonant circuits.

23. A phase slope equalizer according to claim 19 in which, in addition to the set of two inductive posts and capacitive tuning screw, the waveguide section also houses at least one other set of two inductive posts and capacitive tuning screw, the various sets being spaced at predetermined intervals along the waveguide section.

24. A phase slope equalizer according to claim 23 in which all the sets have the same susceptance, the spacing between each outer set and its nearest set is a quarter wavelength and the spacing between any two inner sets is a quarter wavelength or multiples of quarter wavelength.

25. A phase slope equalizer according to claim 23 in which the susceptance of each outer set is half that of each inner set and the spacing between consecutive sets is a quarter wavelength.

26. A phase slope equalizer according to claim 20 in which, in addition to the set of the inductive iris and capacitive tuning screw, the waveguide section also houses at least one other set of inductive iris and capacitive tuning screw, the various sets being spaced at predetermined intervals along the waveguide section.

27. A phase slope equalizer according to claim 26 in which all the sets have the same susceptance, the spacing between each outer set and its nearest set is a quarter wavelength and the spacing between any two inner sets is a quarter-wavelength or multiples of quarter wavelength.

28. A phase slope equalizer according to claim 26 in which the susceptance of each outer set is half that of each inner set and the spacing between consecutive sets is a quarter wavelength.

29. A phase slope equalizer according to claim 21 in which, in addition to the resonant slot, the waveguide section also houses at least one other resonant slot, the various resonant slots being spaced at predetermined intervals along the waveguide section.

30. A phase slope equalizer according to claim 29 in which all the slots have the same susceptance, the spacing between each outer slot and its nearest slot is a quarter wavelength and the spacing between any two inner slots is a quarter-wavelength or multiples of quarter wavelength.

31. A phase slope equalizer according to claim 29 in which the susceptance of each outer slot is half that of each inner slot and the spacing between consecutive slots is a quarter wavelength.

* * * * *